US005941361A

United States Patent [19]

Davidovich et al.

[11] Patent Number: 5,941,361

[45] Date of Patent: Aug. 24, 1999

[54] REMOTE CREEPER SPEED CONTROL

[75] Inventors: Alan A. Davidovich, Garner; Jamison T. Sasser, Apex, both of N.C.

[73] Assignee: Caterpillar Inc., Peoria, Ill.

[21] Appl. No.: 08/962,081

[22] Filed: Oct. 31, 1997

[51] Int. Cl.[6] ..... B60K 41/26

[52] U.S. Cl. ..... 192/220.1; 74/481

[58] Field of Search ..... 192/220.1; 477/94; 74/481

[56] References Cited

U.S. PATENT DOCUMENTS

| | | | |
|---|---|---|---|
| 2,847,875 | 8/1958 | Drain | 74/526 |
| 2,853,164 | 9/1958 | Sturdy . | |
| 2,906,141 | 9/1959 | Kocsi | 74/482 |
| 2,912,880 | 11/1959 | Biggs et al. | 74/526 |
| 3,000,475 | 9/1961 | Arpin . | |
| 3,023,634 | 3/1962 | Tozza | 74/526 |
| 3,050,165 | 8/1962 | Day et al. | 192/220.1 X |
| 3,181,666 | 5/1965 | Dow . | |
| 3,868,003 | 2/1975 | Smith | 192/220.1 |
| 3,999,641 | 12/1976 | Luttrell | 192/220.1 |
| 4,088,208 | 5/1978 | Goode | 192/220.1 |
| 4,114,738 | 9/1978 | Brown et al. | 74/473.17 X |
| 4,246,989 | 1/1981 | Kohler | 192/220.1 |
| 5,228,360 | 7/1993 | Johnson | 74/512 |

*Primary Examiner*—Rodney H. Bonck
*Attorney, Agent, or Firm*—Diana L. Charlton

[57] ABSTRACT

The present invention for a construction machine includes a control knob which is connected to a brake pedal and located remotely therefrom within an operator's compartment. The control knob depresses the brake pedal a predetermined amount to achieve neutralization of the hydrostatic transmission. Neutralization of the hydrostatic transmission is presently available by continuous direct application of the brake pedal. The control knob is adjustable within a plurality of positions to set a selected ground speed which, in turn, allows for increased hydraulic power availability to an implement achieved through the hydrostatic transmission neutralization. An electrical circuit is provided that includes a limit switch which overrides the actuation of a brake light signal unless an operator directly applies pressure to the brake pedal. Therefore, the brake light signal is not actuated during the remote setting of the control knob. The ability to remotely neutralize the hydrostatic transmission and maintain a set ground speed for increased implement control eliminates the need for continuous direct application of the brake pedal which increases operator flexibility and freedom and decreases operator fatigue.

14 Claims, 4 Drawing Sheets

REMOTE CREEPER SPEED CONTROL

TECHNICAL FIELD

This invention relates generally to neutralization of a hydrostatic transmission for a construction machine for diverting power from the hydrostatic transmission to an implement and more particularly to utilization of the hydrostatic transmission neutralization for setting and maintaining a preselected ground speed while allowing full engine speed and hydraulic power for implement control at a remote location from a brake pedal during operation of the construction machine.

BACKGROUND ART

Present construction machines, such as wheel loaders, may utilize the neutralization of a hydrostatic transmission to assist in braking the machine and increasing the hydraulic power availability to an implement. An "inching valve" in fluid communication with the hydrostatic transmission may be used to bleed off a volume of hydraulic control fluid from the hydrostatic transmission which subsequently slows down the machine. Machine ground speed is thus controlled substantially independent of engine speed allowing for increased hydraulic power availability to the implement.

One such approach utilizes a conventional braking system to neutralize the hydrostatic transmission. An operator depresses a brake pedal a predetermined amount which, in turn, moves a piston within a brake cylinder to a position which allows a signal line to be fluidly connected to a tank. The fluid connection between the signal line and the tank creates a pressure drop in the signal line thus neutralizing the hydrostatic transmission. The neutralization of the hydrostatic transmission takes place by the continuous pressure applied to the brake pedal by the operator. The brake pedal is connected to the "inching valve" in such a manner so that the first several degrees of pedal rotation are limited to the neutralization of the hydrostatic transmission without the application of a plurality of brake pads used for actual braking of the machine. In order to achieve a set ground speed for the machine and power availability to the implement as occurs through the neutralization of the hydrostatic transmission, it may be more convenient for the operator to preselect a set ground speed without the direct application of the brake pedal. The brake pedal may be moved remotely through the first several degrees of rotation to eliminate the necessity for the operator's direct and continuous application of the brake pedal. Additionally, it is beneficial to recognize when the operator is actually using the brake pedal for stopping the machine. Therefore, it is advantageous to actuate a brake light signal only when pressure is directly applied to the brake pedal and not during the remote setting of the ground speed.

The present invention is directed to overcoming the problems as set forth above.

DISCLOSURE OF THE INVENTION

In one aspect of the present invention, an adjustable speed control device for increased implement control is disclosed for use on a construction machine having an operator's compartment and a hydrostatic transmission. The device comprises a brake apparatus with a brake pedal located within the operator's compartment and movable between first and second positions. The brake pedal being connected through a brake shaft to a brake cylinder in fluid communication with the hydrostatic transmission. The brake cylinder has a valve operatively associated with the brake pedal within a predetermined portion of the movement between the first and the second positions for neutralizing the hydrostatic transmission. Control means is connected to the brake pedal and located remotely therefrom for moving the brake pedal through the predetermined portion of the movement thereof and for maintaining the brake pedal at any one of a plurality of positions within the predetermined portion of the movement to set a selected ground speed obtained from the neutralization of the hydrostatic transmission during operation of the construction machine.

In another aspect of the present invention, an adjustable speed control device for increased implement control is disclosed for use on a construction machine having an operator's compartment and a hydrostatic transmission. The device comprises a brake apparatus with a brake pedal located within the operator's compartment and movable between first and second positions. The brake pedal being connected through a brake shaft to a brake cylinder in fluid communication with the hydrostatic transmission. The hydrostatic transmission has a valve operatively associated with the brake pedal within a predetermined portion of the movement between the first and the second positions for neutralizing the hydrostatic transmission. Control means is connected to the brake pedal and located remotely therefrom for moving the brake pedal through the predetermined portion of the movement thereof and for maintaining the brake pedal at any one of a plurality of positions within the predetermined portion of the movement to set a selected ground speed obtained from the neutralization of the hydrostatic transmission during operation of the construction machine.

The present invention utilizes a control means to move the brake pedal remotely in such a manner to achieve a selected amount of hydrostatic transmission neutralization for maintaining a set ground speed for the machine which, in turn, allows full engine speed and hydraulic power for implement control. The ability to remotely neutralize the hydrostatic transmission and maintain a set ground speed for increased hydraulic power to control the implement eliminates the continuous direct application of the brake pedal, increasing operator flexibility and freedom while decreasing fatigue. Additionally, the efficiency of the hydrostatic neutralization process is increased due to the ability to set the control means without direct application of the brake pedal.

BEST MODE FOR CARRYING OUT THE INVENTION

Figure 1:
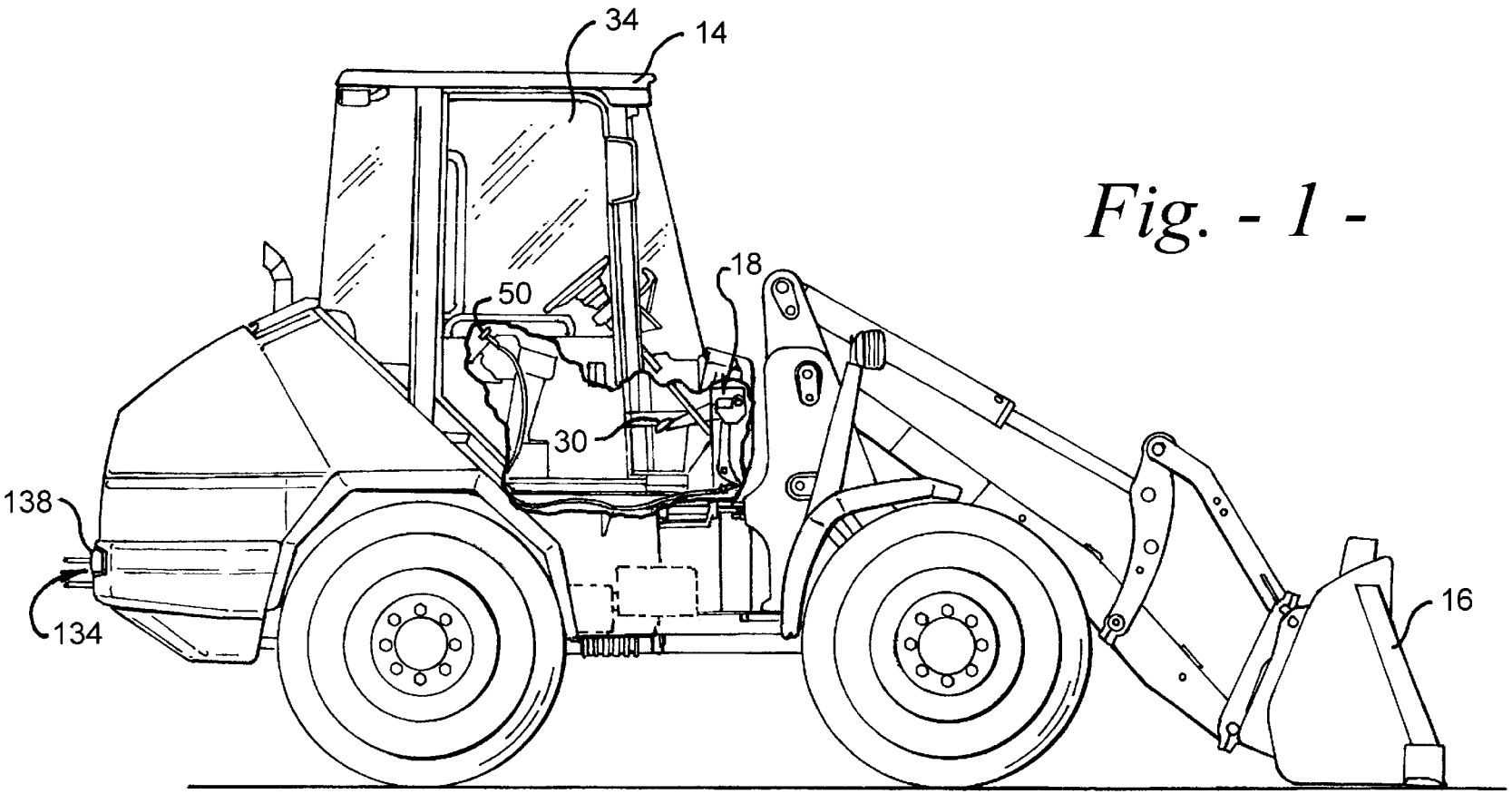
FIG. 1 is a partial diagrammatic side view of a construction machine embodying the present invention.
Figure 2:
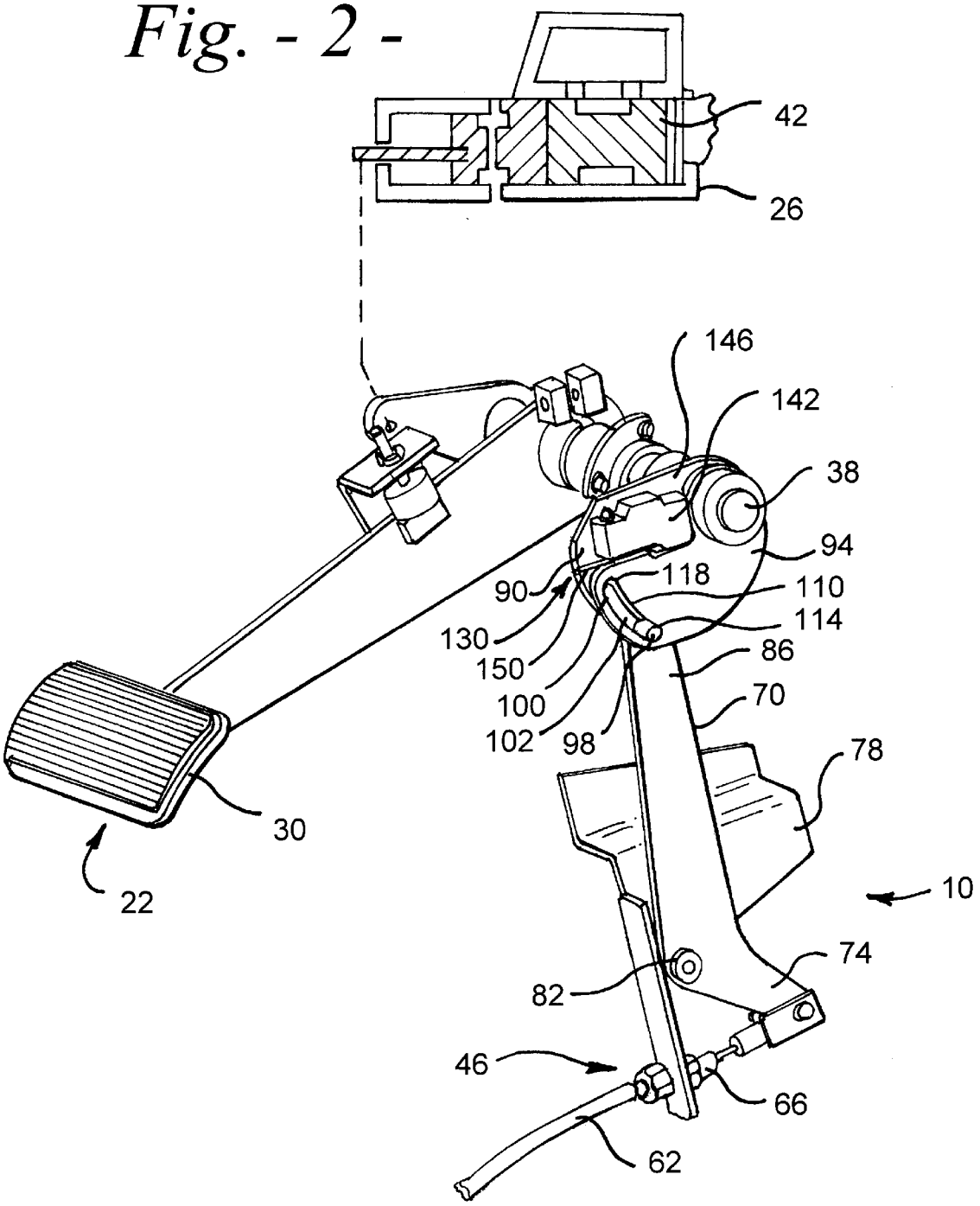
FIG. 2 is a partial diagrammatic isometric view of a braking apparatus and control means for the present invention.
Figure 3:
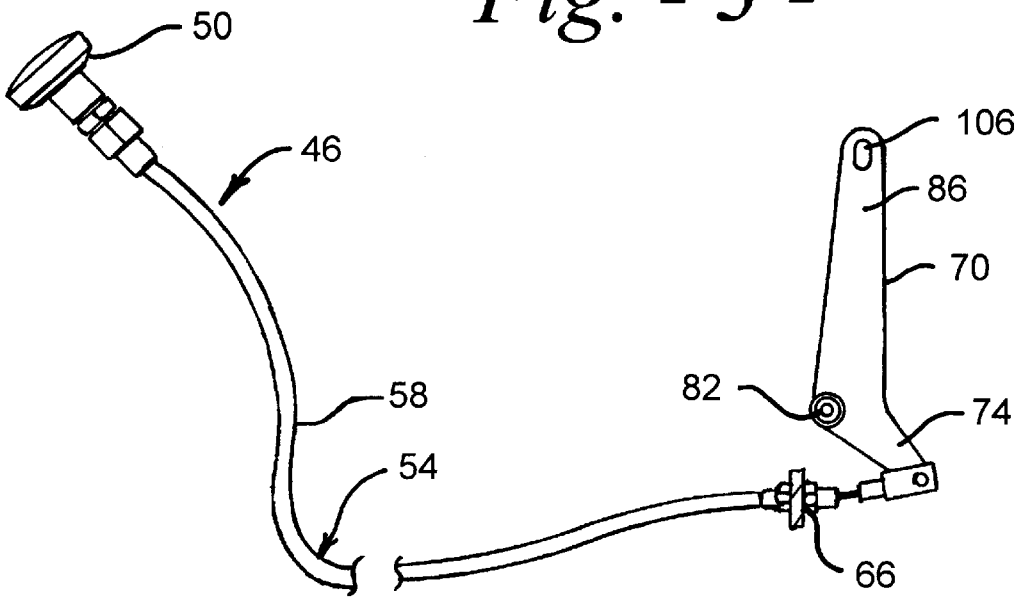
FIG. 3 is a partial side view of cable mechanism and lever assembly of the control means for the present invention.
Figure 4:
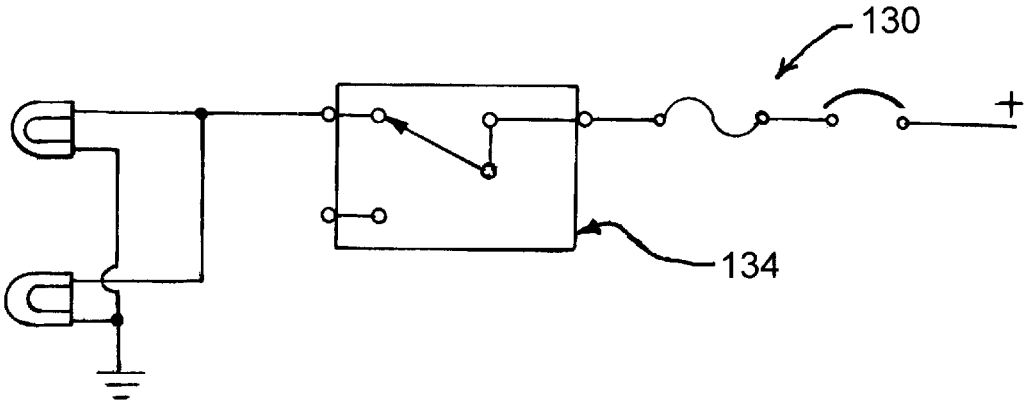
FIG. 4 is a partial diagrammatic schematic view of the electrical system for the present invention.
Figure 5:
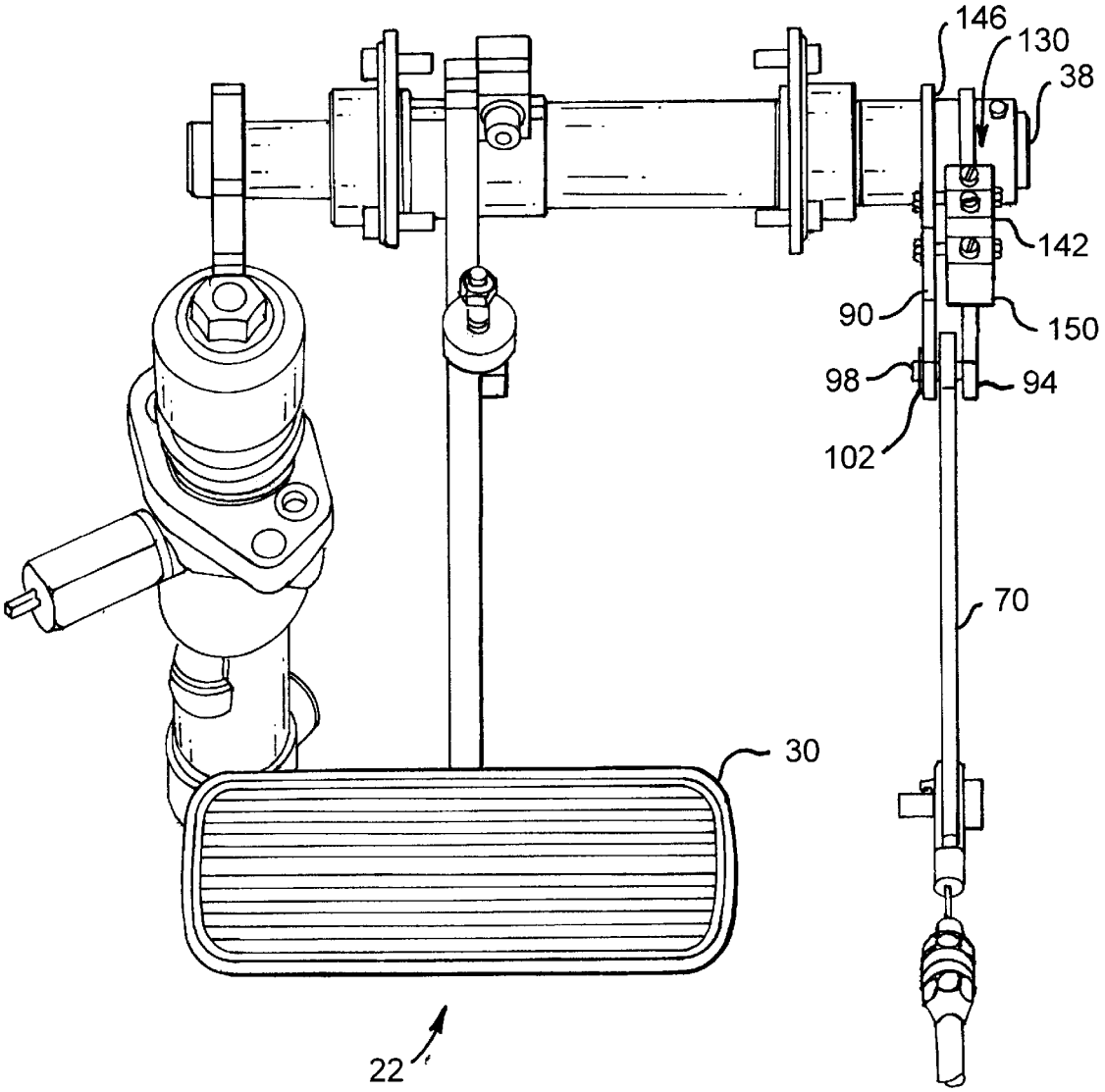
FIG. 5 is a partial diagrammatic front view of the braking apparatus and control means for the present invention.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring to the drawings, it can be seen that a device 10 is illustrated for adjusting the speed of a construction machine 14, such as a wheel loader, while increasing the power availability to control an implement 16, such as a bucket. The construction machine 14 includes a hydrostatic transmission 18 fluidly connected to a brake apparatus 22. The brake apparatus 22 includes a brake cylinder 26 fluidly connected to the hydrostatic transmission 18 in a known manner. A brake pedal 30 is located within a operator's compartment 34 of the construction machine 14 in a well-known manner. It should be understood that the construction machine 14 may or may not include a cab as shown in FIG. 1 without limiting the scope of the invention. The brake pedal 30 is operatively associated with an operator's foot (not shown) or any other suitable device for rotational movement between first and second positions. The brake pedal 30 is connected through a brake shaft 38 to the brake cylinder 26 in a well-known manner. The brake shaft 38 is fixedly connected to the brake pedal 30 for movement therewith. The brake cylinder 26 has an inching valve 42 operative associated in a known manner with the brake pedal 30 to neutralize the hydrostatic transmission 18 when the brake pedal 30 is moved within a predetermined portion of the movement between the first and the second positions which may approximate ten to fifteen degrees of rotation. It should be understood that the inching valve 42 may or may not be integrally connected with the brake cylinder 26 and, therefore, may be separate therefrom without exceeding the scope of the invention. A plurality of brake pads (not shown) are used to stop the construction machine 14 when the brake pedal 30 is moved past the predetermined portion of movement necessary for neutralization of the hydrostatic transmission.

Control means 46 has a control knob 50 located within the operator's compartment 34 remote from the brake pedal 30 for operation by an operator's hand (not shown) or in any suitable manner. The control knob 50 is adjustable within a plurality of positions within a approximate turning range of three rotations. A cable mechanism 54 including a cable 58 disposed within a flexible outer housing 62 extends from the control knob 50 and terminates at a clevis connection 66. A dog-leg shaped lever assembly 70 is connected at a driven end 74 to the cable 58 at the clevis connection 66 for operation with the control knob 50. The lever assembly 70 is mounted for rotation by a bracket 78 to the operator's compartment 34 at a pivot point 82. A driving end 86 of the lever assembly 70 has a length approximately twice that of the driven end 74 and is opposite therefrom. The driving end 86 is positioned between a lever plate 90 and a curved brake plate 94 and connected therebetween by a pin 98. The pivot point 82 is positioned between the driven and driving ends 74,86, respectively, at a location to achieve the least number of turns of the control knob 50 to rotate the lever assembly 70. The brake plate 94 is fixedly connected to the brake shaft 38 in any suitable manner, such as through a spring pin (not shown), and moves dependently therewith and has a distal portion 100 extending outwardly from the connection with the brake shaft 38. The lever plate 90 is connected to the brake shaft 38 for rotation thereabout and is spaced approximately 10 mm from the brake plate 94. The pin 98 is fixedly connected on the lever plate 90 in any suitable manner, such as welding, and extends outwardly from a lower portion 102 thereof. The pin 98 extends through a defined slot 106 on the driving end 86 of the lever assembly 70 and into a defined slot 110 in the brake plate 94. The slot 110 in the brake plate 94 has a arcuate shape with first and second ends 114,118 defining a range of motion for the brake plate 94 to rotate therebetween when the brake pedal 30 is directly applied.

An electrical circuit 130 is connected to the brake pedal 30 and includes a brake light signal 134 actuated by a switch control (not shown) in a well-known manner, such as through direct application or depression of the brake pedal 30. The brake light signal 134 includes a bulb (not shown) which is illuminated when the brake light signal 134 is actuated. A brake light cover 138 is connected to the rear of the construction machine 14 in a well-known manner. A limit switch 142 which has a non-energized open position and an energized closed position is provided within the electrical circuit 130 between the control switch (not shown) and the brake light signal 134. The limit switch 142 is connected to an upper portion 146 of the lever plate 90 and has a contact point 150 which extends outwardly from the lever plate 90 toward the brake plate 94.

Industrial Applicability

Initially, the pin 98 extends from the lever plate 90 through the slot 106 in the lever assembly 70 and into the brake plate 94 so that the pin 98 is abutted against the first end 114 of the slot 110. The brake plate 94 is spaced sufficiently from the lever plate 90 to ensure that the distal portion 100 contacts to close and energize the limit switch 142 at the contact point 150 when the pin 98 is abutted against the first end 114 of the slot 110. The control knob 50 is turned which rotates the driven end 74 of lever assembly 70 inwardly toward the control knob 50 through the pivot point 82. The rotation of the driven end 74 propels the driving end 86 of the lever assembly 70 opposite the driven end 74. A pressure is exerted from the lever assembly 70 against the pin 98 which causes the simultaneous rotation of the lever and the brake plates 90,94, respectively, about the brake shaft 38. The direction of movement of the lever assembly 70 and the location of the pin 98 against the first end 114 of the slot 110 provides a constant contact between the brake plate 94 and the contact point 150 of the limit switch 142 throughout the rotation of the lever assembly 70. The rotation of the brake plate 94 simultaneously depresses the brake pedal 30 moving it through the predetermined portion of the movement which neutralizes the hydrostatic transmission 18. The control knob 50 may be set at any one of the plurality of positions to fix the lever assembly 70 rotation and maintain the brake pedal 30 in any of a plurality of depressed positions within the predetermined portion of movement. The ability to depress the brake pedal 30 remotely through the control knob 50 allows an operator to select a ground speed which provides increased hydraulic power availability to the implement through the neutralization of the hydrostatic transmission. The ability to maintain the brake pedal 30 at any one of a plurality of positions within the predetermined portion of movement remotely through the control knob 50 increases the operator's freedom of movement.

The direct application of the brake pedal 30 rotates the brake plate 94 independently from the lever plate 90. The brake plate 94 rotates with the brake shaft 38 about the pin 98 within the range of motion allowed by the slot 110 independent from the lever plate 90. The independent rotation of the brake plate 94 moves the distal portion 100 thereof out of contact with the limit switch contact point 150 thereby opening and de-energizing the limit switch 142 and permitting actuation of the brake light signal 134. The actuation of the brake light signal 134 signifies, by the illumination of the bulb (not shown), that the operator intends to significantly slow or stop the construction machine 14.

Other aspects, objects and advantages of this invention can be obtained from a study of the drawings, disclosure and the appended claims.

We claim:

1. An adjustable speed control device for increased implement control on a construction machine having an operator's compartment and a hydrostatic transmission, comprising:

a brake apparatus including a brake pedal locatable within the operator's compartment and movable between first and second positions, the brake pedal being connected through a brake shaft to a brake cylinder which is fluidly communicable with the hydrostatic transmission, the brake cylinder having a valve operatively associated with the brake pedal within a predetermined portion of the movement between the first and the second positions for neutralizing the hydrostatic transmission; and control means connected to the brake pedal and located remotely therefrom for moving the brake pedal through the predetermined portion of the movement thereof and for maintaining the brake pedal at any one of a plurality of positions within the predetermined portion of the movement to set a selected ground speed obtained from the neutralization of the hydrostatic transmission during operation of the construction machine.

2. The adjustable speed control device of claim 1, wherein the brake shaft is fixedly connected with the brake pedal for movement therewith and the control means includes a first plate fixedly connected to the brake shaft for movement therewith, a second plate connected to the brake shaft and spaced a predetermined distance from the first plate, a lever assembly connected to the first and second plates at a first end through a pin extending therebetween and a cable mechanism connected to a second end of the lever assembly for pivoting the lever assembly within a predetermined range of motion to simultaneously rotate the first and the second plates dependently about the brake shaft so that the first plate moves the brake pedal through the predetermined portion of the movement between the first and the second positions.

3. The adjustable speed control device of claim 2, wherein the braking apparatus has an electrical circuit connected to the brake pedal and includes a brake light signal actuated by the direct application of the brake pedal between the first and the second positions and a limit switch located between the brake pedal and the brake light signal.

4. The adjustable speed control device of claim 2, wherein the braking apparatus has an electrical circuit connected to the brake pedal and includes a brake light signal actuated by the movement of the brake pedal between the first and the second positions and a limit switch located between the brake pedal and the brake light signal, the limit switch is connected to the second plate and is energized by contact with the first plate to override the actuation of the brake light signal during the simultaneous rotation of the first and the second plates established by the pivotal movement of the lever assembly.

5. The adjustable speed control device of claim 4, wherein the limit switch is de-energized by direct application of the brake pedal which rotates the first plate out of contact with the limit switch to permit the actuation of the brake light signal.

6. The adjustable speed control device of claim 5, wherein the direct application of the brake pedal rotates the first plate independently from the second plate.

7. The adjustable speed control device of claim 2, wherein the lever assembly includes a pivot point located at a predetermined position between the first and second ends thereof and is located between the first and the second plates.

8. The adjustable speed control device of claim 7, wherein the cable mechanism includes a cable disposed within a flexible outer housing which extends from a control knob adjustable within a plurality of positions and terminates at a clevis connection with the lever assembly so that when the control knob is turned the lever assembly pivots through the predetermined range of motion and may be fixed at any location therealong by setting the control knob at any one of the plurality of positions.

9. The adjustable speed control device of claim 8, wherein the pivot point is located to achieve a travel ratio of one to three translated from the control knob to the lever assembly.

10. The adjustable speed control device of claim 9, wherein the control knob is turned by an operator's hand.

11. The adjustable speed control device of claim 6, wherein the pin is fixedly connected on the second plate and extends through a defined slot on the first end of the lever assembly and further extends through a defined slot in the first plate, the defined slot in the first plate having first and second ends separated by the length thereof and defining a predetermined range of motion.

12. The adjustable speed control device of claim 11, wherein the pin is in abutment with the first end of the defined slot in the first plate and maintained thereagainst during the pivoting of the lever assembly.

13. The adjustable speed control device of claim 12, wherein the independent movement of the first plate from the second plate includes the first plate rotating about the pin along any of a plurality of positions along the predetermined range of motion allowed by the defined slot in the first plate.

14. An adjustable speed control device for increased implement control on a construction machine having an operator's compartment and a hydrostatic transmission, comprising:

a brake apparatus including a brake pedal locatable within the operator's compartment and movable between first and second positions, the brake pedal being connected through a brake shaft to a brake cylinder which is fluidly communicable with the hydrostatic transmission, the hydrostatic transmission having a valve operatively associated with the brake pedal within a predetermined portion of the movement between the first and the second positions for neutralizing the hydrostatic transmission; and control means connected to the brake pedal and located remotely therefrom for moving the brake pedal through the predetermined portion of the movement thereof and for maintaining the brake pedal at any one of a plurality of positions within the predetermined portion of the movement to set a selected ground speed obtained from the neutralization of the hydrostatic transmission during operation of the construction machine.

* * * * *